US009622939B2

(12) United States Patent
Buxton-Dakides

(10) Patent No.: US 9,622,939 B2
(45) Date of Patent: Apr. 18, 2017

(54) DIAL CAP FOR MEDICINE BOTTLE

(71) Applicant: Patricia Buxton-Dakides, Laguna Niguel, CA (US)

(72) Inventor: Patricia Buxton-Dakides, Laguna Niguel, CA (US)

( * ) Notice: Subject to any disclaimer, the term of this patent is extended or adjusted under 35 U.S.C. 154(b) by 104 days.

(21) Appl. No.: 13/907,651

(22) Filed: May 31, 2013

(65) Prior Publication Data

US 2014/0008319 A1 Jan. 9, 2014

Related U.S. Application Data

(63) Continuation-in-part of application No. 13/544,344, filed on Jul. 9, 2012, now abandoned.

(51) Int. Cl.

| | |
|---|---|
| ***B65D 50/00*** | (2006.01) |
| ***A61J 1/03*** | (2006.01) |
| *A61J 7/04* | (2006.01) |
| *A61J 1/14* | (2006.01) |

(52) U.S. Cl.

CPC ..... *A61J 1/03* (2013.01); *A61J 1/1425* (2015.05); *A61J 7/04* (2013.01); *Y10T 29/49826* (2015.01)

(58) Field of Classification Search

CPC ..... B65D 41/3404; B65D 50/041; B65D 50/062; B65D 51/245; B65D 55/022; B65D 2583/0409; A61J 1/1425; A61J 1/03; A61J 7/04

USPC ..... 215/230, 201, 202, 216, 219; 206/534, 206/459.1, 528, 540; 116/308, 309

See application file for complete search history.

(56) References Cited

U.S. PATENT DOCUMENTS

| | | | | |
|---|---|---|---|---|
| 261,131 | A * | 7/1882 | Bonshire | 116/309 |
| 2,767,680 | A * | 10/1956 | Lermer | 116/308 |
| 3,648,872 | A * | 3/1972 | Durso | B65D 50/046 215/220 |
| 3,960,713 | A * | 6/1976 | Carey | 206/534 |
| 3,996,879 | A * | 12/1976 | Walton | 116/308 |
| 5,082,129 | A * | 1/1992 | Kramer | 215/221 |
| 5,115,929 | A * | 5/1992 | Buono | 215/220 |
| 5,520,307 | A * | 5/1996 | Miller et al. | 221/2 |
| 5,765,706 | A * | 6/1998 | Barker et al. | 215/230 |
| 6,003,467 | A * | 12/1999 | Shelton-Ferrell et al. | 116/309 |
| 6,089,180 | A * | 7/2000 | Nichols, Jr. | 116/309 |
| 7,886,909 | B2 * | 2/2011 | Robinson | 206/534 |
| 7,980,391 | B2 | 7/2011 | Adler et al. | |
| 8,220,629 | B2 * | 7/2012 | Crosby | 206/385 |
| 8,371,464 | B2 * | 2/2013 | Rachuk et al. | 215/230 |
| 2006/0236814 | A1 * | 10/2006 | Chan et al. | 81/3.4 |
| 2008/0099423 | A1 * | 5/2008 | Koch | 215/230 |
| 2010/0270257 | A1 | 10/2010 | Wachman et al. | |
| 2011/0266250 | A1 | 11/2011 | Adler et al. | |
| 2011/0284415 | A1 * | 11/2011 | Balakier et al. | 206/459.1 |

* cited by examiner

*Primary Examiner* — Anthony Stashick
*Assistant Examiner* — Ernesto Grano
(74) *Attorney, Agent, or Firm* — John D. Tran; Rhema Law Group

(57) ABSTRACT

A method includes: providing a dial cap having vertical sides that meet at corners and the vertical sides including an aperture; coupling an info ring to the dial cap and seated within the dial cap; and wherein coupling the info ring includes coupling the info ring having a symbol configured to align with the aperture.

18 Claims, 8 Drawing Sheets

DIAL CAP FOR MEDICINE BOTTLE

CROSS-REFERENCE TO RELATED APPLICATION(S)

The present application is a Continuation In Part patent application and claims priority benefit, with regard to all common subject matter, of earlier-filed U.S. Non-Provisional Utility Application entitled: "DIAL CAP FOR MEDICINE BOTTLE", Ser. No. 13/544,344, filed Jul. 9, 2012. The identified earlier-filed application is hereby incorporated by reference in its entirety into the present application.

INCORPORATION BY REFERENCE

Applicant(s) hereby incorporate herein by reference any and all U.S. patents and U.S. patent applications cited or referred to in this application.

FIELD OF THE INVENTION

Aspects of this invention relate generally to medicine pill bottles or containers, and more particularly to an improved dial cap system.

BACKGROUND OF THE INVENTION

As is known in the art, a variety of medicine pill bottles and/or containers exist, which house medicine in the form of pills, tablets or liquids. Typically, the medicine bottle top or "cap" is plain with no markings and is often "child-proof" in the sense that the user must "push down" or "squeeze" and turn the medicine bottle cap in a certain way to unlock or open the cap to allow dispensing of the contained medicine contents. These types of standard medicine bottle pill caps typically do not contain any helpful medical dispensing information.

As known in the pharmaceutical and medical industry, one of the greatest dangers in dispensing medicine in medicine pill bottles are the hazards of inconsistent or incorrect labeling which leads to potential health dangers of users taking wrong medication or wrong doses etc. . . . .

There have been recent attempts to provide medicine pill bottles that have been redesigned to provide more medicine information on the bottle than previous iterations. For example, U.S. Pat. No. 7,980,391 and U.S. Patent Publication No. 2006/0163103 both issued to Deborah Adler et. al., discloses a medicine pharmacy bottle which aims to provide a medicine bottle that can contain, among other things, additional medical information. This attempt has resulted in a bulky hard to store and handle medicine bottle as well as increasing the costs of manufacturing by requiring a specially made bottle rather than utilizing a standard prescription pill bottle.

Other attempts have been made to provide for a medicine pill bottle cap that can provide medical information to a patient in addition to what information is normally contained on the medicine pill bottle container. For example, U.S. Patent Publication No. 2010/0270257A1 (Wachman et. al.) discloses a medicine bottle with electronic embedded curved display. However, the dial cap of this invention requires the need for electronic circuitry which adds both to the costs of manufacturer and the complexity of use for the average user.

Currently, there is not a dial cap system that provides a user with important medical timing and/or quantity dispensing information in a cost effective manner. Thus the need for a dial cap system that meets these needs has been long felt in the industry. Prior developments have not taught or suggested any solutions to overcome all of the limitations described above, and thus, solutions to overcome these limitations have long eluded those skilled in the art.

SUMMARY OF THE INVENTION

The present invention provides a system and method of manufacturing for a dial cap system including: a dial cap having vertical sides that meet at corners and the vertical sides including an aperture; an info ring coupled to the dial cap and configured to be seated within the dial cap; and wherein the info ring includes a symbol configured to align with the aperture.

Though providing the correct medical information and dosage on a medical bottle to a user is obviously important, this does not do enough to ensure that the user is taking his or her medication properly. Many medications require the user or patient to be vigilant in taking the medication at several pre-determined times or quantities throughout the day. For example, a Physician may prescribe a medication that requires the user/patient to take every four hours or be required to take two pills at every dosage. However, for whatever reason, the patient may forget what time he last took his medicine or forget what time is he supposed take his next medication. Such patient errors or mistakes in taking their medications as prescribed leads to unnecessary sickness and costly hospitalizations.

In addressing the long felt need in the industry, the inventor has discovered a new and improved dial cap system which can easily and efficiently inform a user regarding timing and/or quantity information helpful to the user in taking their medication properly.

In addition, the inventor has discovered a new and improved dial cap system which provides a stabilizing shape to prevent falling over and rolling onto the floor causing difficulties for individuals who have mobility issues. In one exemplary embodiment, the stabilizing shape is in the form of a triangle.

The inventor has also discovered a new and improved dial cap system that provides minimal amount of handling of enabling patients to leave their meds in the original container, utilizing the time indicator for ease of correct dosage, rather than transferring medications into another medication organizer. For example, the new and improved dial cap system prevents accidental contamination of medication that may spill out during a transfer to a new container and also prevents errors in confusing different types of medication with other types of medication.

Aspects of the present invention teach certain benefits in construction and use which give rise to the exemplary advantages described below.

In an exemplary embodiment, a dial cap system according to aspects of the invention is configured to provide specific timing information in regards to the medical dispensing activities related to the contents in a particular medicine bottle. The dial cap system comprising a first body, a second body, wherein the second body is coupled to the first body; wherein the second body having a base and a wall, wherein the base is a plane perpendicular to the wall; wherein the second body is comprised of a set of informative symbols selected from a group consisting of numbers or letters; wherein a plurality of receptacles are disposed on the base of the second body, the plurality of receptacles are in an array equally distributed in a circular arrangement; wherein a set of informative symbols is disposed on the wall of the second body, the set of informative symbols are distributed in an array corresponding to the array of the plurality of receptacles on the base, wherein each one of the plurality of the receptacles lines up with one of the set of informative symbols; wherein the first body having a top portion, a side portion and a center chamber, wherein the top portion is disposed perpendicularly to the side portion to form the center chamber; wherein the top portion having a plurality of protrusions distributed in an array corresponding to the array of the plurality of receptacles on the base of the second body; wherein the side portion of the first body having a plurality of tabs, the plurality of tabs are perpendicular to the top portion of the first body, each one of the plurality of tabs having a hook protruding inwardly towards the center chamber; and wherein the side portion of the first body having an aperture, the aperture having a dimension corresponding to a dimension of each one of the set of informative symbols on the wall of the second body.

In one embodiment, a dial cap system is depicted that is adaptable to already pre-existing medicine bottle containers;

In another embodiment, a dial cap system provides medical dispensing timing and/or quantity information;

In another embodiment, a dial cap system provides medical dispensing timing and/or quantity information in a relatively cost-effective and simple way;

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The invention is illustrated in the figures of the accompanying drawings which are meant to be exemplary and not limiting, in which like references are intended to refer to like or corresponding parts, and in which.

Figure 1:
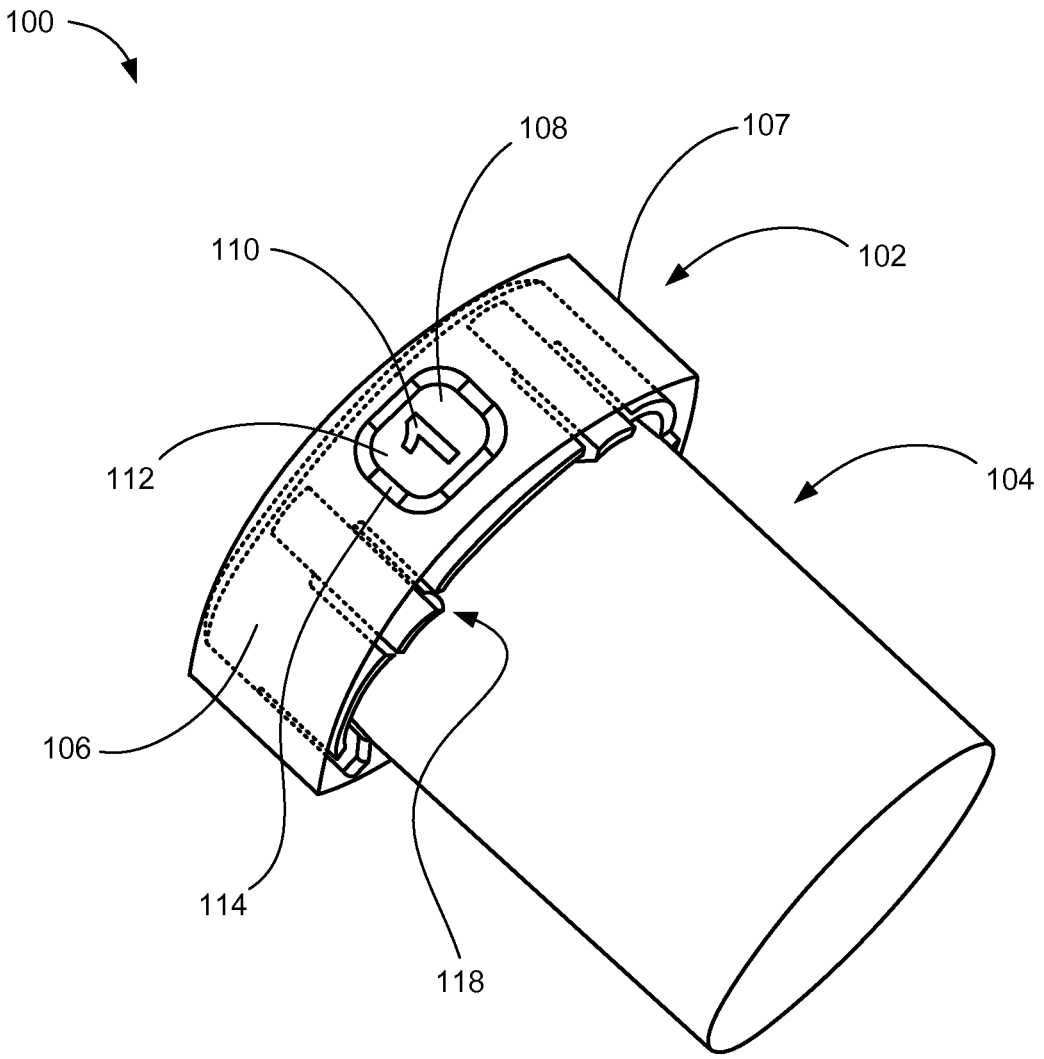
FIG. 1 is an isometric view of a dial cap system in a first embodiment of the present invention.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. To accomplish the above and related objects, this invention may be embodied in the form illustrated in the accompanying drawings, attention being called to the fact, however, that the drawings are illustrative only, and that changes may be made in the specific construction illustrated.

DETAILED DESCRIPTION OF THE INVENTION

The invention and its various embodiments can now be better understood by turning to the following detailed description of the preferred embodiments, which are presented as illustrated examples of the invention defined in the claims. The following embodiments are described in sufficient detail to enable those skilled in the art to make and use the invention. It is expressly understood that the invention as defined by the claims may be broader than the illustrated embodiments described below.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claims are set forth below in a certain combination, it must be expressly understood that the invention includes other combinations of fewer, more of different elements, which are disclosed herein even when not initially claimed in such combinations.

The above-described drawing figures illustrate aspects of the invention in at least one of its exemplary embodiments, which are further defined in detail in the following description.

In the following description, numerous specific details are given to provide a thorough understanding of the invention; however, it will be apparent that the invention may be practiced without these specific details. In order to avoid obscuring the present invention, some well-known circuits, system configurations, and process steps are not disclosed in detail.

For expository purposes, the term "horizontal" as used herein is defined as a plane parallel to the plane or surface of the top surface of the dial cap, regardless of its orientation. The term "vertical" refers to a direction perpendicular to the horizontal as just defined. Terms, such as "above", "below", "bottom", "top", "side" (as in "sidewall"), "higher", "lower", "upper", "over", and "under", are defined with respect to the horizontal plane. The term "on" means there is direct contact among elements.

Referring now to FIG. 1, therein is shown an isometric view of a dial cap system 100 in a first embodiment of the present invention. The dial cap system 100 is depicted having a dial cap 102 on a bottle 104.

The dial cap 102 can have a geometrical shape such as the shape of a triangle which makes it easier to turn and open. The triangle shape also provides a stabilizing feature which prevents or reduces the chances of the dial cap system from falling over and rolling onto the floor which prevents and/or reduces accidental medication spills and also avoids difficulties for individuals having mobility issues from having the need to pick up the dial cap system from the ground or at a lower position that is difficult for an mobility challenged individual to access. The dial cap 102 can be manufactured in an environmental friendly material and be in the color of green to denote that.

Although the current embodiment depicts a triangular shape, other shapes are contemplated such as square, pentagonal, or even irregular shapes. The dial cap 102 can include vertical sides 106 peripheral to the bottle 104 and that contact a top portion of the bottle 104.

The vertical sides 106 can meet at corners 107. The corners can be sharp or rounded. The corners 107 can include grip formed thereon.

The shape of the dial cap 102 being triangular effectively extends the leverage on the dial cap 102 allowing for less force to be used when opening the dial cap system 100. The dial cap 102 shape functions as fulcrums that multiply the torque of a user making the dial cap system 100 more ergonomic.

Within the vertical sides 106 of the dial cap 102, an aperture 108 is depicted extending through the vertical sides 106 of the dial cap 102 to reveal a symbol 110. The symbol 110 can be placed on an info ring 112.

The info ring 112 can reside inside of the dial cap 102 between the vertical sides 106 of the dial cap 102 and the top portion of the bottle 104. The symbol 110 can be an informative symbol that conveys information about the date of future doses, dates of previous doses, expiration dates, quantities, kinds of contents, and other information about the contents of the bottle 104 or the usage of the contents of the bottle 104.

A perimeter portion that surrounds the aperture 108 can further include indicator marks 114. The indicator marks 114 can indicate whether the bottle was last closed on the current symbol 110 or was closed on a previous symbol 110. This can ensure that the symbol 110 depicted within the aperture 108 is in a current or known state.

The indicator marks 114 can further move as a counter and indicate how many times the dial cap 102 has been opened with the same symbol 110 within the aperture 108, this allows for the dial cap 102 to track and count the amount of openings and or closings per symbol 110. The symbol 110 can further change within the aperture 108 based on when the dial cap 102 was closed, how many times the dial cap 102 was closed with the symbol 110 showing within the aperture 108, or based on the indicator marks 114 when the dial cap 102 was last attached to the bottle 104.

By changing the indicator marks 114 and the symbol 110 the dial cap system 100 can aid a user in the proper use of the medicine contained within the bottle. The dial cap system 100 can help to ensure multiple doses are not consumed. The dial cap system 100 can further ensure that the use of the medicine is consistently documented.

It is also contemplated that the symbol 110 can be selected by rotating the dial cap 102 around the info ring 112 until the desired symbol 110 is displayed within the aperture 108. For example, if a user wanted to remind himself to take his medication at 1 pm, the user would simply rotate the dial cap 102 around the info ring 112 until the symbol 110 displayed within the aperture 108 was a 1, or a 1 pm, or a 1300.

While a particular number pattern is shown as a set of the symbol 110, it will be appreciated that such a set of numbers is merely illustrative and that the invention is not so limited and said set of informative symbols may consists of other informative symbols such as letters or roman numerals. The aperture 108 can have a dimension corresponding to a dimension of each one of the symbol 110.

The dial cap 102 may further include multiple apertures 108 on each of the vertical sides 106 of the dial cap 102. The info ring 112 may have the symbol 110 arranged on the info ring 112 so that the same symbol 110 is always showing on each of the multiple apertures 108 at the same time.

Extending from below the dial cap 102 are tabs 116 each with a hook 118. The hook 118 on each of the tabs 116 can extend inward toward the bottle 104 while the tabs 116 can be parallel to the vertical sides 106. The hook 118 on each of the tabs 116 can secure the info ring 112 to the dial cap 102 and offer resistance to the movement of the info ring 112 within the dial cap 102. The info ring 112 can either be secured or affixed to the bottle 104 or to the dial cap 102.

Figure 2:
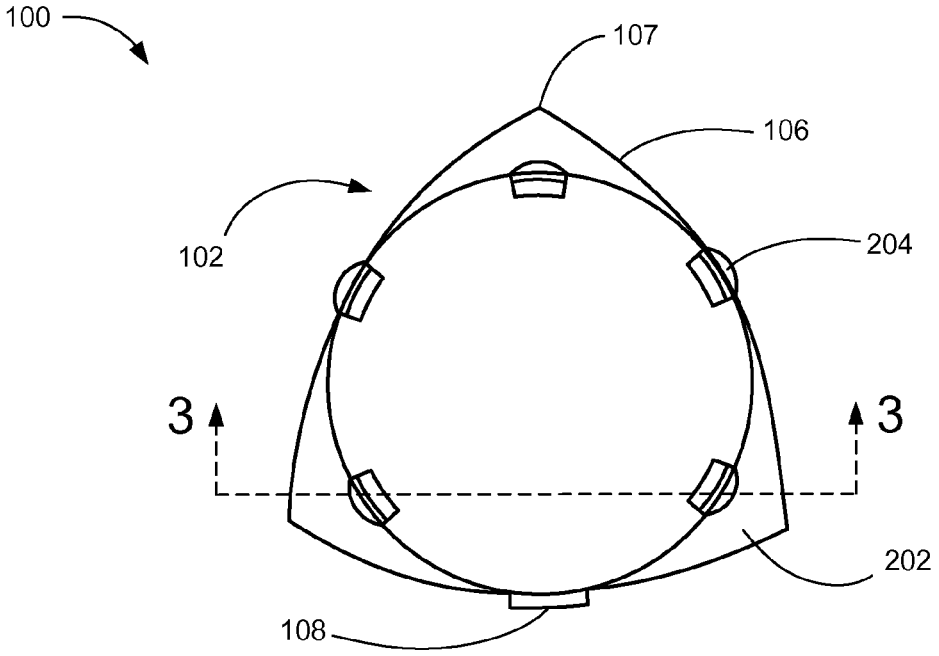
FIG. 2 is a top view of the dial cap system of FIG. 1.

Referring now to FIG. 2, therein is shown a top view of the dial cap system 100 of FIG. 1. The dial cap system 100 is shown with the dial cap 102 having a top surface 202 and the vertical sides 106.

Along the vertical sides 106, the dial cap 102 is shown having protrusions 204. The protrusions 204 are shown extending beyond two of the vertical sides 106 between the corners 107, while the aperture 108 is shown on the last of the vertical sides 106.

The vertical sides 106 are shown in roughly a triangle shape but with a curvature to allow for a more ergonomic feel. The vertical sides 106 having a curvature can still produce the substantial mechanical gains allowing for increased torque but provide a softer, gentler feel. The vertical sides 106 are shown in direct contact and meeting at the corners 107 therebetween.

The protrusions 204 are placed in the middle of two of the vertical sides 106. The protrusions 204 are placed where the fingers of an adult user would naturally fall when grasping the dial cap 102. In this way the protrusions 204 are easy to depress for an adult.

The protrusions 204 must be pressed in simultaneously with the twisting of the dial cap 102 to remove the dial cap 102 from the bottle 104 of FIG. 1.

Figure 3:
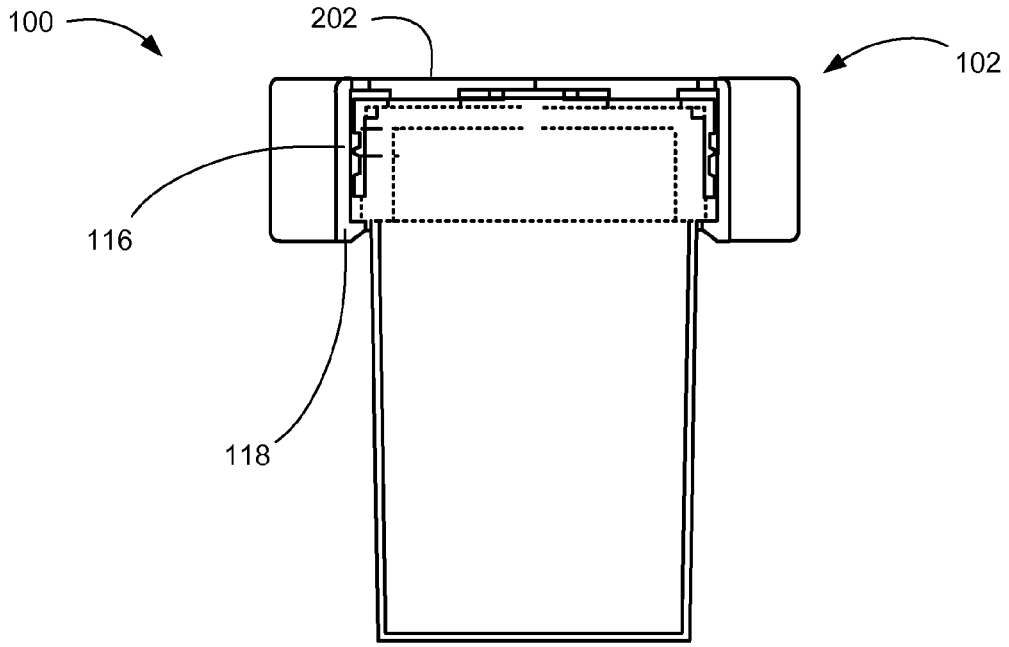
FIG. 3 is a cross-sectional view of the dial cap system along the lines 3-3 of FIG. 2.

Referring now to FIG. 3, therein is shown a cross-sectional view of the dial cap system 100 along the lines 3-3 of FIG. 2. The dial cap 102 is shown with the tabs 116 having the hook 118.

The tabs 116 can extend perpendicular to the top surface 202 of the dial cap 102. The hook 118 can be used in conjunction with the tabs 116 to secure the dial cap 102 onto the bottle 104 in a way that is child proof. The hook 118 can also secure the info ring 112 of FIG. 1 within the dial cap 102.

Figure 4:
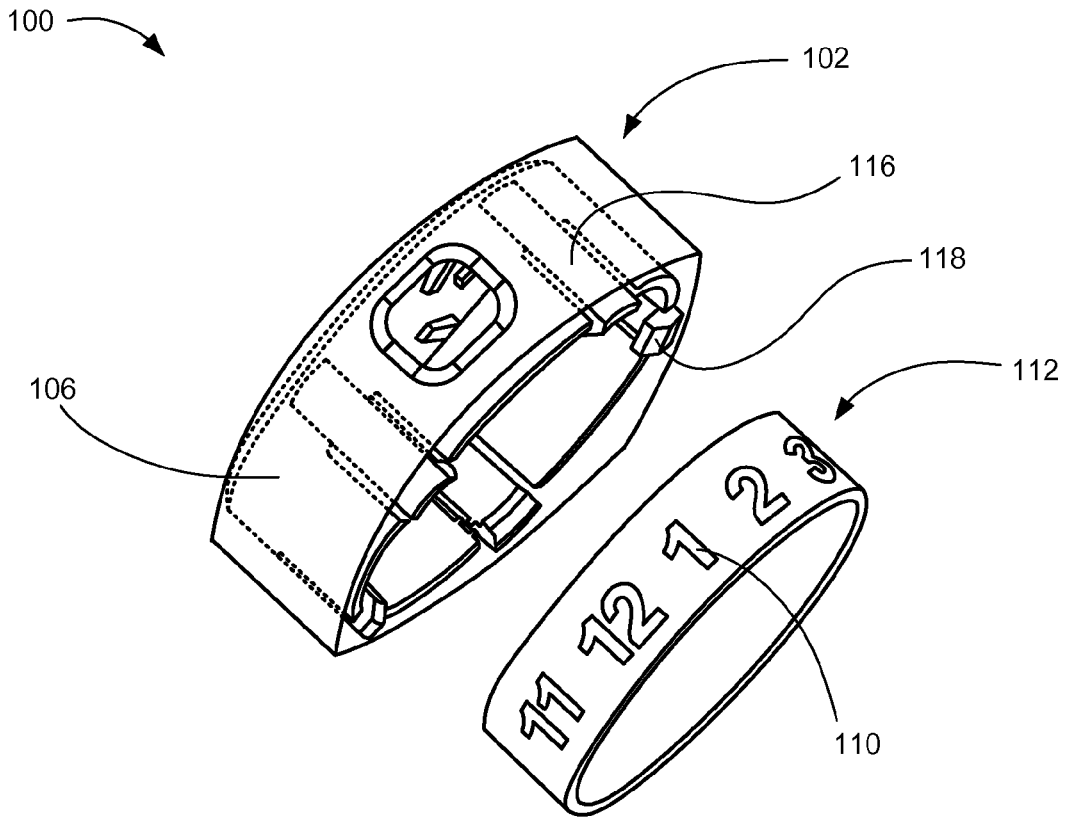
FIG. 4 is a partial exploded view of the dial cap system of FIG. 1.

Referring now to FIG. 4, therein is shown a partial exploded view of the dial cap system 100 of FIG. 1. The dial cap 102 is shown having the hook 118 of the tabs 116 aligned to the info ring 112.

The info ring 112 is shown having the symbols 110 formed thereon. The vertical sides 106 are shown as smooth but it is contemplated that the vertical sides 106 may include patterns formed into the vertical sides 106 to provide increased grip on the dial cap 102. The patterns can be vertical lines spaced apart at regular intervals, uneven intervals, or in another form such as a cross hatch pattern.

Figure 5:
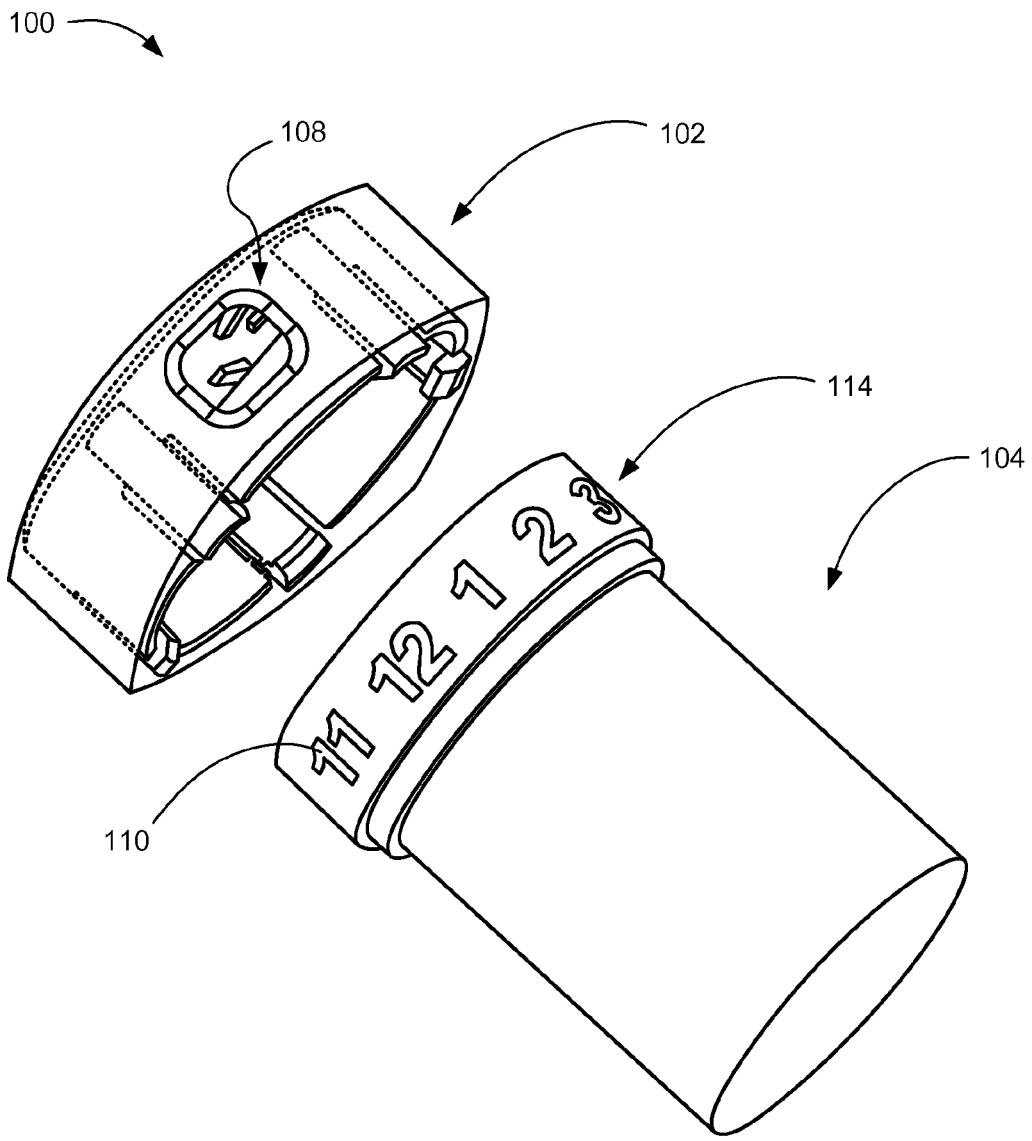
FIG. 5 is an exploded view of the dial cap system of FIG. 1.

Referring now to FIG. 5, therein is shown an exploded view of the dial cap system 100 of FIG. 1. The dial cap system 100 is shown having the dial cap 102 aligned with the bottle 104.

The info ring 112 is shown mounted onto the bottle 104. The info ring 112 can be affixed to the bottle 104 in a way that the symbols 110 are always facing away from the same area of the bottle 104. When this is the case, the aperture 108 of the dial cap 102 will move relative to the bottle 104 in order to display the proper symbol 110 within the aperture 108.

The info ring 112 can also be mounted to the bottle 104 in a non-fixed way that allows for the info ring 112 to spin on the bottle 104. This allows for the dial cap 102 to be attached to the bottle 104 in the same direction after each use. If the dial cap 102 is attached to the bottle 104 in the same direction after each use, the info ring 112 can be moved relative to both the dial cap 102 and the bottle 104 to display a different symbol 110 within the aperture 108.

One of the advantages of the present dial cap system 100 is that it can be easily adapted to fit on an industry standard medicine bottle which negates the need to manufacture a specialized medicine bottle. As clearly seen, in one exemplary embodiment, the set of symbol 110 can be in the form of numbers ranging from one to twelve which allows the user the ability to conveniently select the appropriate numeral to remind them to properly take their medication at an appropriate time or at the appropriate quantity.

Figure 6:
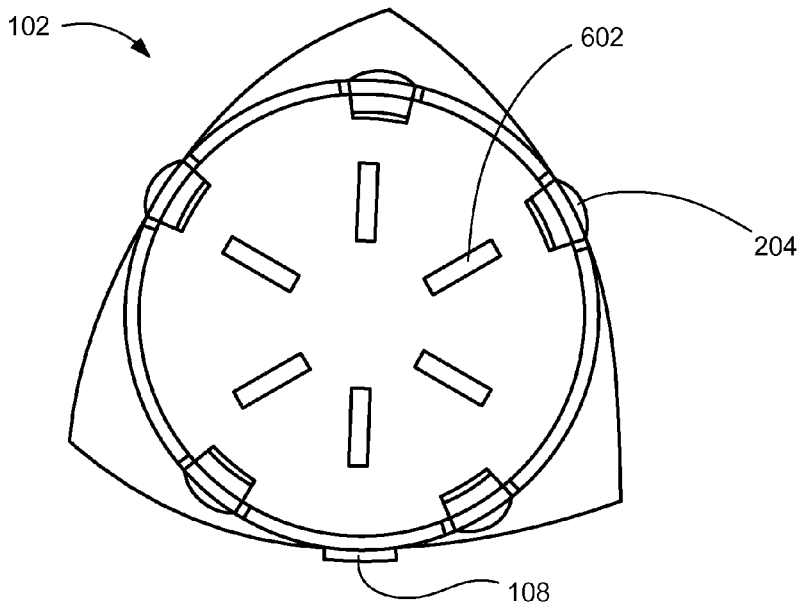
FIG. 6 is a bottom view of the dial cap of FIG. 1.

Referring now to FIG. 6, therein is shown a bottom view of the dial cap 102 of FIG. 1. The dial cap 102 is shown having structural reinforcements 602 formed on the back surface of the top surface 202 of FIG. 2.

The vertical sides 106 of the dial cap 102 are shown having the protrusions 204 extending therefrom on two of the vertical sides 106. The vertical sides 106 are also depicted having the aperture 108 formed in the third one of the vertical sides 106. The hook 118 on the tabs 116 is shown extending inward toward the center of the dial cap 102.

Figure 7:
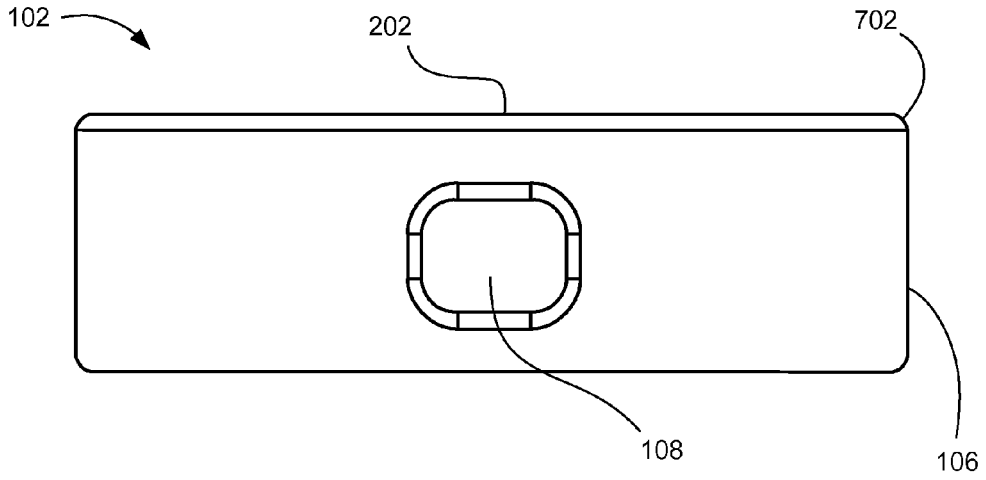
FIG. 7 is a side view of the dial cap of FIG. 1.

Referring now to FIG. 7, therein is shown a side view of the dial cap 102 of FIG. 1. The dial cap 102 is shown having the aperture 108 within the vertical sides 106 of the dial cap 102.

The top surface 202 can transition from the top surface 202 to the vertical sides 106 with a rounded corner 702. The rounded corners 702 can greatly increase comfort and the ergonomics of the dial cap 102.

Figure 8:
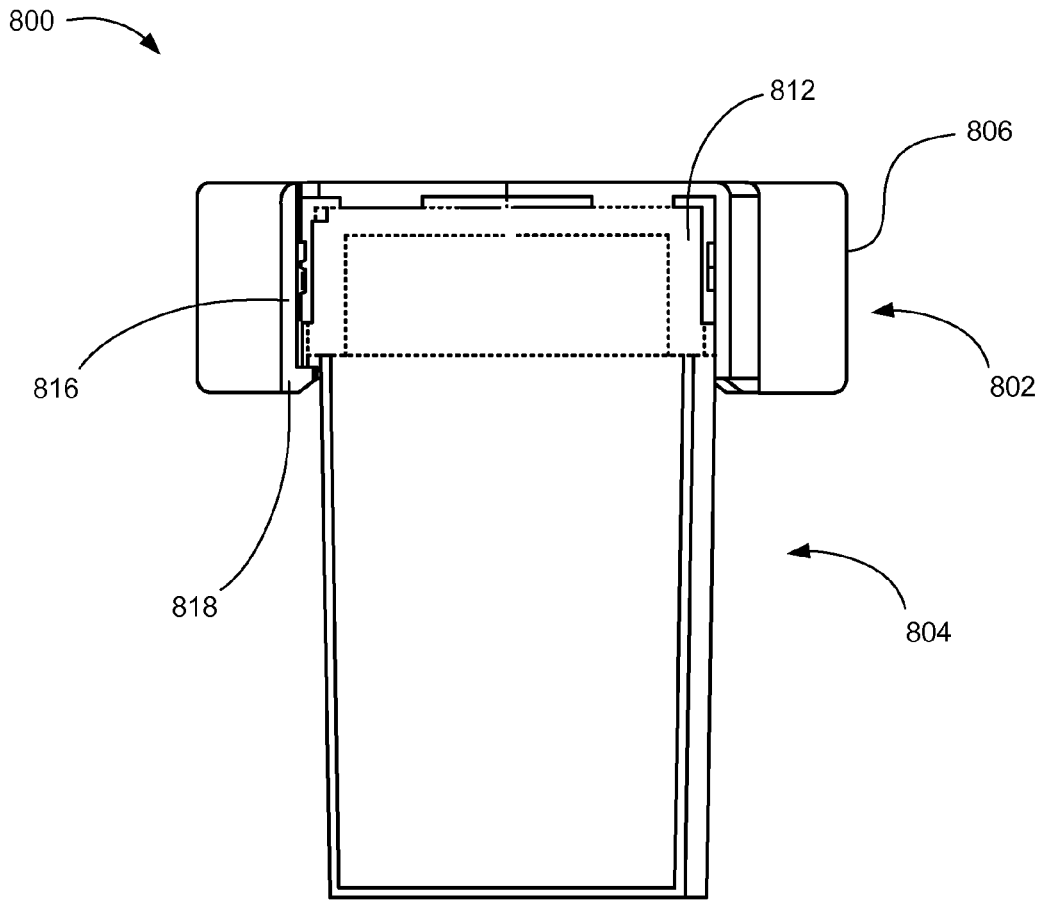
FIG. 8 is a cross-sectional view of the dial cap system in a second embodiment of the present invention.

Referring now to FIG. 8, therein is shown a cross-sectional view of the dial cap system 800 in a second embodiment of the present invention. The dial cap system 800 is depicted having a dial cap 802 on a bottle 804.

The dial cap 802 can have a geometrical shape such as the shape of a triangle which makes it easier to turn and open. The dial cap 802 can be manufactured in an environmental friendly material and be in the color of green to denote that.

Although the current embodiment depicts a triangular shape, other shapes are contemplated such as square, pentagonal, or even irregular shapes. The dial cap 802 can include vertical sides 806 peripheral to the bottle 804 and that contact a top portion of the bottle 804.

The shape of the dial cap 802 being triangular effectively extends the leverage on the dial cap 802 allowing for less force to be used when opening the dial cap system 800. The dial cap 802 shape functions as fulcrums that multiply the torque of a user making the dial cap system 800 more ergonomic.

Within the vertical sides 806 of the dial cap 802, an aperture can extend through the vertical sides 806 of the dial cap 802 to reveal a symbol. The symbol can be placed on an info ring 812.

The info ring 812 can reside inside of the dial cap 802 between the vertical sides 806 of the dial cap 802 and the top portion of the bottle 804. The symbol can be an informative symbol that conveys information about the date of future doses, dates of previous doses, expiration dates, quantities, kinds of contents, and other information about the contents of the bottle 804 or the usage of the contents of the bottle 804.

Extending from below the dial cap 802 are tabs 816 each with a hook 818. The hook 818 on each of the tabs 816 can extend inward toward the bottle 804 while the tabs 816 can be parallel to the vertical sides 806. The hook 818 on each of the tabs 816 can secure the info ring 812 to the dial cap 802 and offer resistance to the movement of the info ring 812 within the dial cap 802. The info ring 812 can either be secured or affixed to the bottle 804 or to the dial cap 802.

Figure 9:
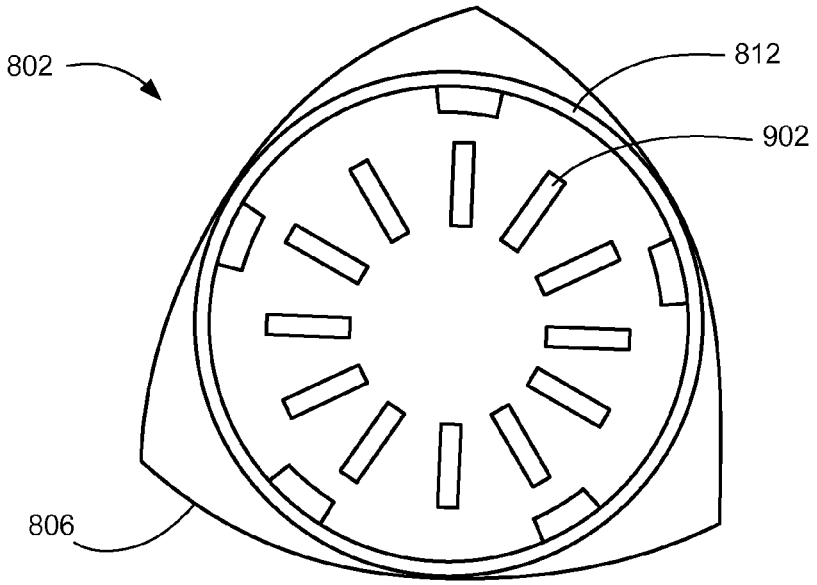
FIG. 9 is a bottom view of the dial cap of FIG. 8.

Referring now to FIG. 9, therein is shown a bottom view of the dial cap 802 of FIG. 8. The dial cap 802 is shown having the info ring 812 seated therein.

The info ring 812 can be seen extending perpendicular to the vertical sides 806 and containing receptacles 902 disposed on the info ring 812. The receptacles 902 are in an array equally distributed in a circular arrangement and in alignment with symbols on a wall of the info ring 812. The dial cap 802 is rotatable along an axis of the info ring 812, wherein partial rotations of the dial cap 802 moves a protrusion on the dial cap 802 into a corresponding receptacle 902 on the info ring 812.

The symbols are distributed in an array corresponding to the receptacles 902, wherein each one of the receptacles 902 lines up with one of the symbols. The dial cap 802 can be rotated with reference to the symbols corresponding to the plurality of receptacles 902 which allows the dial cap 802 and info ring 812 to be securely fixed in a set position.

Because the symbols are also distributed in an array corresponding to the array of the receptacles 902, it ensures that each of the receptacles 902 lines up with one of the symbols thereby allowing an aperture opening on the dial cap 802 to properly align with the symbol.

Figure 10:
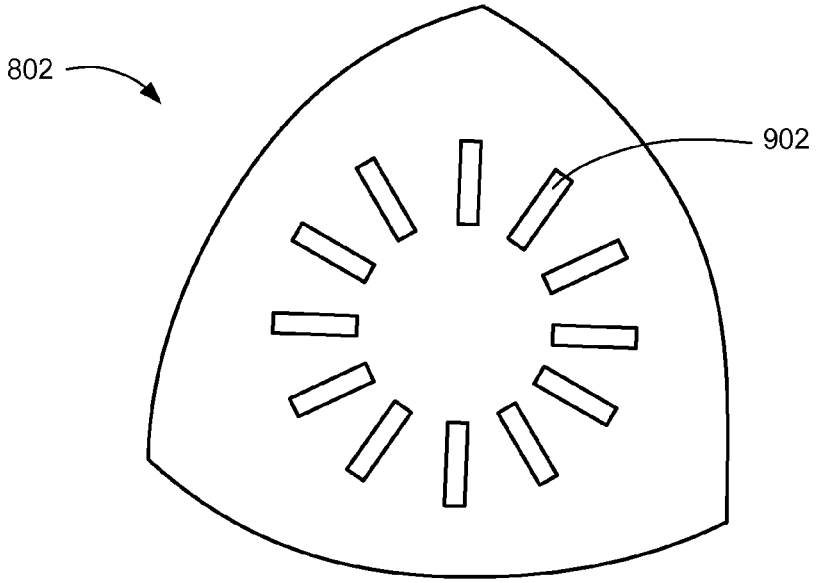
FIG. 10 is a top view of the dial cap of FIG. 8.

Referring now to FIG. 10, therein is shown a top view of the dial cap 802 of FIG. 8. The dial cap 802 is depicted having the receptacles 902 showing there through. The receptacles 902 can ensure that the symbols are aligned with the aperture so that the symbol is properly showing within the aperture.

Figure 11:
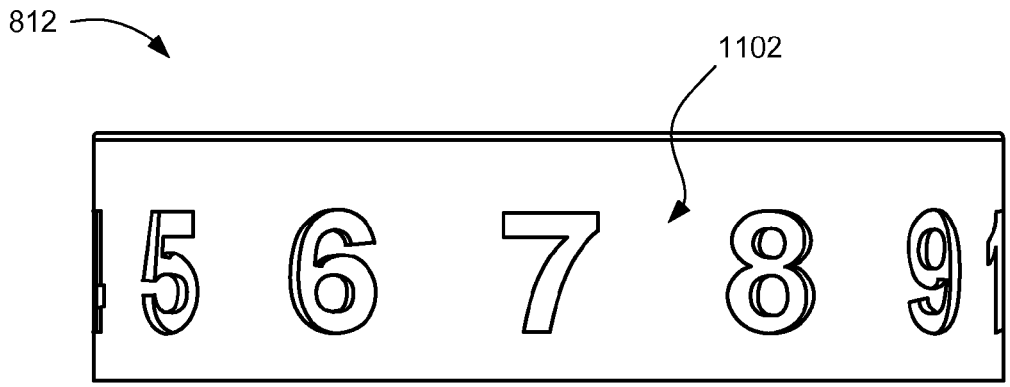
FIG. 11 is an isometric view of the info ring of FIG. 8.

Referring now to FIG. 11, therein is shown an isometric view of the info ring 812 of FIG. 8. The info ring 812 is shown having symbols 1102 formed in an equally distributed array around an outer surface of the info ring 812. The symbols 1102 symbols 26 can consists of numbers, letters or roman numerals.

Figure 12:
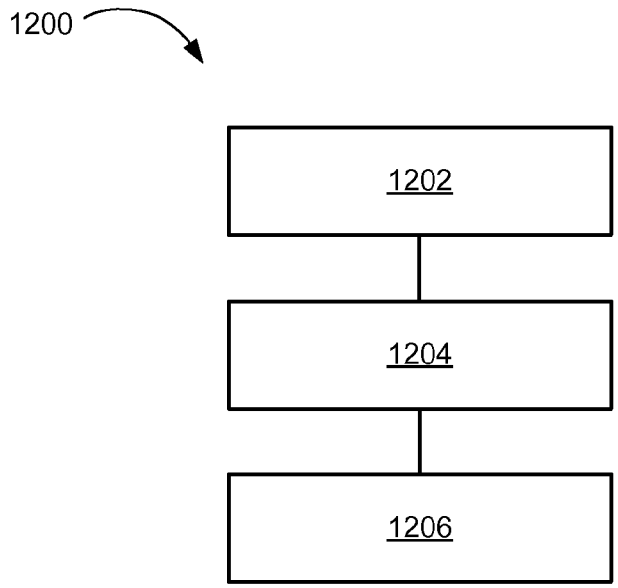
FIG. 12 is a flow chart of a method of manufacturing the dial cap system in an embodiment of the present invention.

Referring now to FIG. 12, therein is shown a flow chart of method of manufacturing 1200 the dial cap system 100 in an embodiment of the present invention. The method of manufacturing 1200 includes: providing a dial cap having vertical sides that meet at corners and the vertical sides including an aperture in a block 1202; coupling an info ring to the dial cap and seated within the dial cap in a block 1204; and wherein coupling the info ring includes coupling the info ring having a symbol configured to align with the aperture in a block 1206.

Thus, it has been discovered that the dial cap system of the present invention furnish important and heretofore unknown and unavailable solutions, capabilities, and functional aspects.

The resulting processes and configurations are straightforward, cost-effective, uncomplicated, highly versatile, accurate, sensitive, and effective, and can be implemented by adapting known components for ready, efficient, and economical manufacturing, application, and utilization.

While the invention has been described in conjunction with a specific best mode, it is to be understood that many alternatives, modifications, and variations will be apparent to those skilled in the art in light of the above description.

Accordingly, it is intended to embrace all such alternatives, modifications, and variations, which fall within the scope of the included claims. All matters set forth herein or shown in the accompanying drawings are to be interpreted in an illustrative and non-limiting sense.

It should be noted that the various features of each above-described embodiment may be combined in any logical manner and are intended to be included within the scope of the present invention. It will also be appreciated by those skilled in the art that the present invention is not limited to the particular geometries and materials of construction disclosed, but may instead entail other functionally comparable structure, now known or later developed, without departing from the spirit and scope of the invention. Furthermore, while aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A dial cap system, comprising:

a dial cap having sides, the sides being curved, the sides arranged as a curved triangle, the sides in direct contact with corners therebetween, the sides include an aperture and protrusions, wherein a perimeter portion that directly surrounds the aperture 108 includes indicator marks and the indicator marks for indicating whether the dial cap system was last closed on a current symbol or was closed on a previous symbol and for ensuring the current symbol depicted within the aperture is in a known state, the protrusions extended out away from the sides and between the corners, and the dial cap configured to release from a bottle based on the protrusions being pressed in simultaneously with the dial cap being twisted;

an info ring coupled to the dial cap and configured to be seated within the dial cap; and wherein the info ring includes the previous symbol and the current symbol, the previous symbol and the current symbol configured to align with the aperture.

2. The system of claim 1, wherein the dial cap includes a tab having a hook coupled to the info ring to secure the dial cap and the info ring together.

3. The system of claim 1, wherein the previous symbol and the current symbol are selected from the group consisting of numbers, letters, and roman numerals.

4. The system of claim 1, wherein the bottle is a standard medicine bottle container.

5. The system of claim 1, wherein the aperture on the sides of the dial cap displays the current symbol on the info ring.

6. The system of claim 1, wherein a rotation of the dial cap is clockwise or counter clockwise.

7. The system of claim 1, wherein the dial cap fits over the bottle and the bottle is a pill bottle or a liquid container.

8. The system of claim 1, wherein the aperture is centered within one of the sides.

9. The system of claim 1, wherein each of the sides includes the aperture.

10. A method of manufacturing a dial cap system, comprising:

providing a dial cap having sides, the sides being curved, the sides arranged as a curved triangle, the sides in direct contact with corners therebetween, the sides include an aperture and protrusions, wherein a perimeter portion that directly surrounds the aperture 108 includes indicator marks and the indicator marks for indicating whether the dial cap system was last closed on a current symbol or was closed on a previous symbol and for ensuring the current symbol depicted within the aperture is in a known state, the protrusions extended out away from the sides and between the corners, and the dial cap configured to release from a bottle based on the protrusions being pressed in simultaneously with the dial cap being twisted;

coupling an info ring to the dial cap and seated within the dial cap; and wherein coupling the info ring includes coupling the info ring having the previous symbol and the current symbol, the previous symbol and the current symbol configured to align with the aperture.

11. The method of claim 10, wherein providing the dial cap includes providing the dial cap having a tab having a hook configured to couple to the info ring to secure the dial cap and the info ring together.

12. The method of claim 10, coupling the info ring includes coupling the info ring having the previous symbol and the current symbol selected from the group consisting of numbers, letters, and roman numerals.

13. The method of claim 10, wherein providing the dial cap includes providing the dial cap adaptable to fit the bottle and the bottle is a standard medicine bottle container.

14. The method of claim 10, wherein providing the dial cap includes providing the aperture on the sides of the dial cap configured to display the current symbol on the info ring.

15. The method of claim 10, wherein providing the dial cap includes providing the dial cap being rotatable clockwise or counter clockwise.

16. The method of claim 10, wherein providing the dial cap includes providing the dial cap configured to fit over the bottle and the bottle is a pill bottle or a liquid container.

17. The method of claim 10, wherein providing the dial cap includes providing the aperture centered within one of the sides.

18. The method of claim 10, wherein providing the dial cap includes providing each of the sides including the aperture.

* * * * *